US005544783A

United States Patent [19]

Conigliaro

[11] Patent Number: 5,544,783

[45] Date of Patent: Aug. 13, 1996

[54] SPRAY CAN ACCESSORY HOLDER

[76] Inventor: Charles Conigliaro, 769 SW. Lighthouse Dr., Palm City, Fla. 34990

[21] Appl. No.: 409,906

[22] Filed: Mar. 22, 1995

Related U.S. Application Data

[63] Continuation of Ser. No. 189,575, Jan. 31, 1994, abandoned.

[51] Int. Cl.[6] ..... B67D 5/06

[52] U.S. Cl. ..... 220/735; 215/390; 222/538

[58] Field of Search ..... 215/14, 100 R, 215/101, 386, 390, 391, 399; 220/915, 710, 735, 744; 206/229; 222/530, 538; 239/391, 396

[56] References Cited

U.S. PATENT DOCUMENTS

| | | | |
|---|---|---|---|
| 1,330,470 | 2/1920 | Jutila | 215/390 X |
| 1,903,410 | 4/1933 | Cecil | 215/390 X |
| 2,744,649 | 5/1956 | Smith | 215/390 |
| 2,949,203 | 8/1960 | Berg | 215/100 R X |
| 3,008,164 | 11/1961 | Herman et al. | 220/735 X |
| 3,880,281 | 4/1975 | Taddei | 206/217 |
| 4,141,445 | 2/1979 | Korich . | |
| 4,183,444 | 1/1980 | English et al. . | |
| 4,232,785 | 11/1980 | Lucas | 206/228 |
| 4,715,505 | 12/1987 | DeMars | 215/100 R |
| 4,819,838 | 4/1989 | Hart, Jr. | 222/538 |
| 5,048,709 | 9/1991 | Alverson | 215/1 A X |
| 5,140,723 | 8/1992 | Genzel | 24/1 DR |
| 5,143,263 | 9/1992 | Newell | 222/538 |
| 5,178,354 | 1/1993 | Engvall | 220/735 X |
| 5,289,961 | 3/1994 | Leviti et al. | 224/247 |
| 5,301,858 | 4/1994 | Hollander | 224/148 |

*Primary Examiner*—Allan N. Shoap
*Assistant Examiner*—Nathan Newhouse
*Attorney, Agent, or Firm*—Quarles & Brady

[57] ABSTRACT

A clip-on device adaptable for attachment to a aerosol container, the device having a bracket for securing a tubular conduit member to be used to direct a spray product from the aerosol container outlet to a point of destination.

1 Claim, 5 Drawing Sheets

SPRAY CAN ACCESSORY HOLDER

This is a continuation of application Ser. No. 08/189,575, filed Jan. 31, 1994, (now abandoned).

BACKGROUND OF THE INVENTION

This invention relates to improvements relating to various aerosol container products. Typically, when one utilizes an aerosol spray container, the spray cannot be directed with great precision unless an aid such as a straw is used. Straws have become popular in use with various lubricant spray products. The use of a straw held to the outlet of a spray container enables the lubricant or other product to be directed to a precise area such as within a small opening designed to receive lubricants on a piece of a machinery or the like.

Unfortunately, an item such as a straw or comparable tubular conduit member can easily be lost unless it is attached to the spray container when not in use. While straws serve as a function for precisely directing a spray product, often they are unnecessary and, in fact, not desirable when a spray product is used. Accordingly, with such irregular usage, a straw becomes difficult to avoid misplacing. Once such a straw is lost, there is often no substitute product available of a precise dimension desired.

Manufacturers for products such as aerosol lubricants have been marketing their containers with straws taped to the container. This may be fine for the initial marketing of the product but it becomes impractical to retape the straw to the container between times when the straw is used to direct the container spray.

SUMMARY OF THE INVENTION

The novel clip-on device of the subject invention answers the above needs by providing a simple yet inexpensive and efficient means to attach a straw to a container when not in use. The straw by means of a friction-fitted bracket can easily be squeezed into a storage position during non-use. As easily, the straw can be pried from its bracket on the clip-on device when its use is desired to direct the spray of the product precisely from the spray outlet of the container.

The nature of the novel clip-on device is such that it may produced and sold with the spray container products. In the alternative, the clip-on device may be sold separately and used repeatedly with different spray containers as they replace one another.

OBJECT OF THE INVENTION

Therefore, it is an important object of the invention of the subject invention to provide an inexpensive, simple means for attaching a straw to an aerosol spray container.

It is a further object of the subject invention to provide a means which will enable the straw to be quickly released and, in turn, resecured to the holding means.

It is yet a further object of the invention to provide a type of holding device which will eliminate the likelihood that a straw delivery product will be lost when not in use as it is easily separable from the aerosol container unit.

It is but a further object of the subject invention to provide a straw holder which can easily be attached to a container by simply pushing the device against the container.

These and further objects will become apparent from the following discussion as read in conjunction with the drawings wherein like reference numerals designate like elements throughout the discussion.

DETAILED DESCRIPTION OF THE INVENTION

Figure 1:
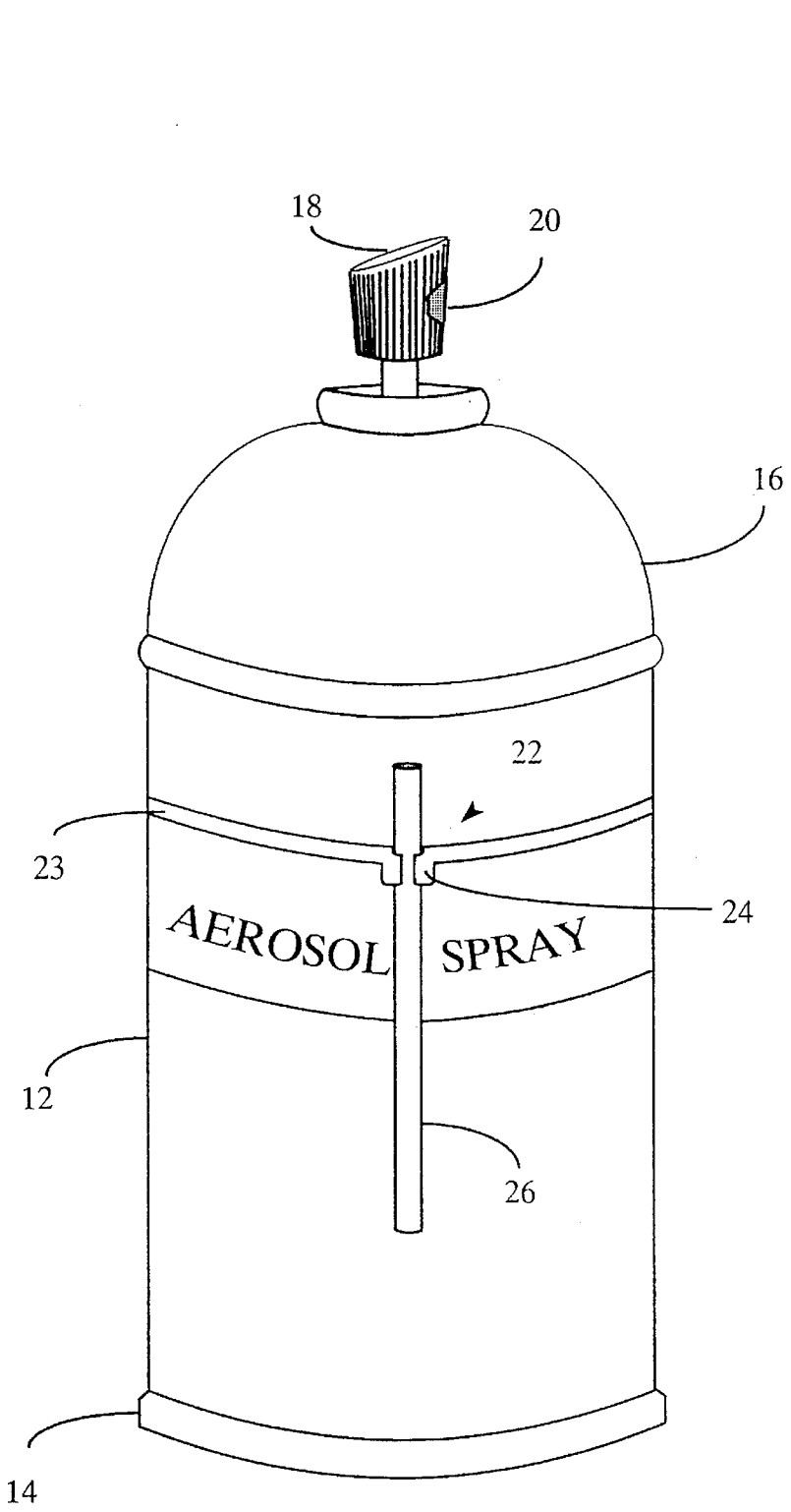
FIG. 1 is a perspective view of an aerosol dispensing container with a clip-on device attached thereon in accordance with the invention.

With reference to FIG. 1, a perspective view of the invention is shown wherein the aerosol container 10 of cylindrical construction is shown with side wall 12 further having a base 14. A dome top 16 is shown with a dispenser button 18 having an outlet 20.

Such aerosol container 10 is typically used for lubricants and the like wherein such spray will deliver the product to a designated area in need of lubrication.

With further reference to FIG. 1, a clip-on device 22 is shown having flexible clip 23. The flexible clip 23 is constructed of a plastic or similar material which, because of its thin dimension, is flexible and spring like in nature. This enables the clip to be force-fitted onto the aerosol container whereby the dimensional compatibility will enable the clip-on device 22 to engage the side wall 12 of container 10 in such manner that no slippage will occur.

Figure 2:
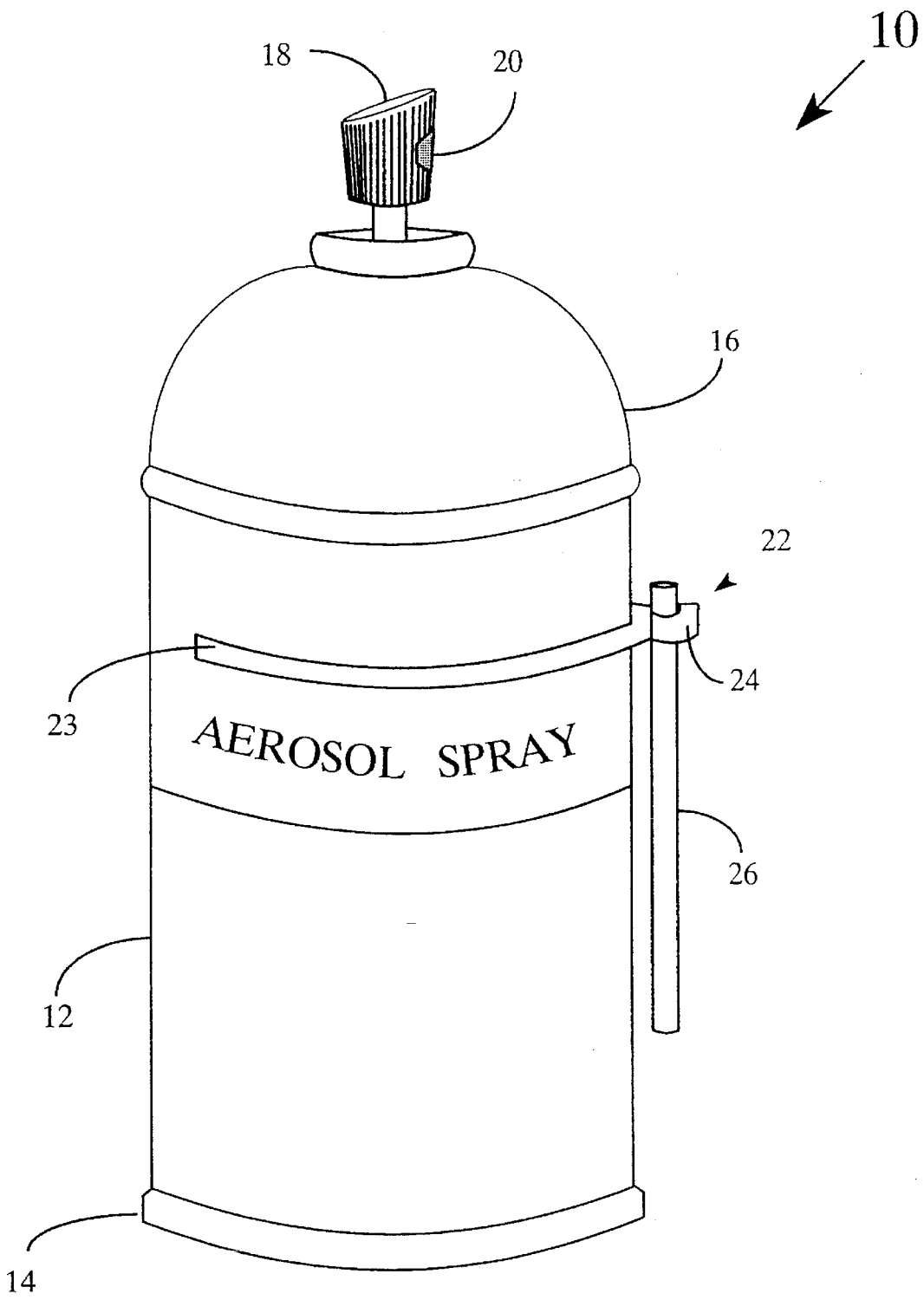
FIG. 2 is a side, elevational view of the aerosol container with clip-on device attached thereto and in which a straw is seen held in the bracket of the clip-on device.
Figure 3:
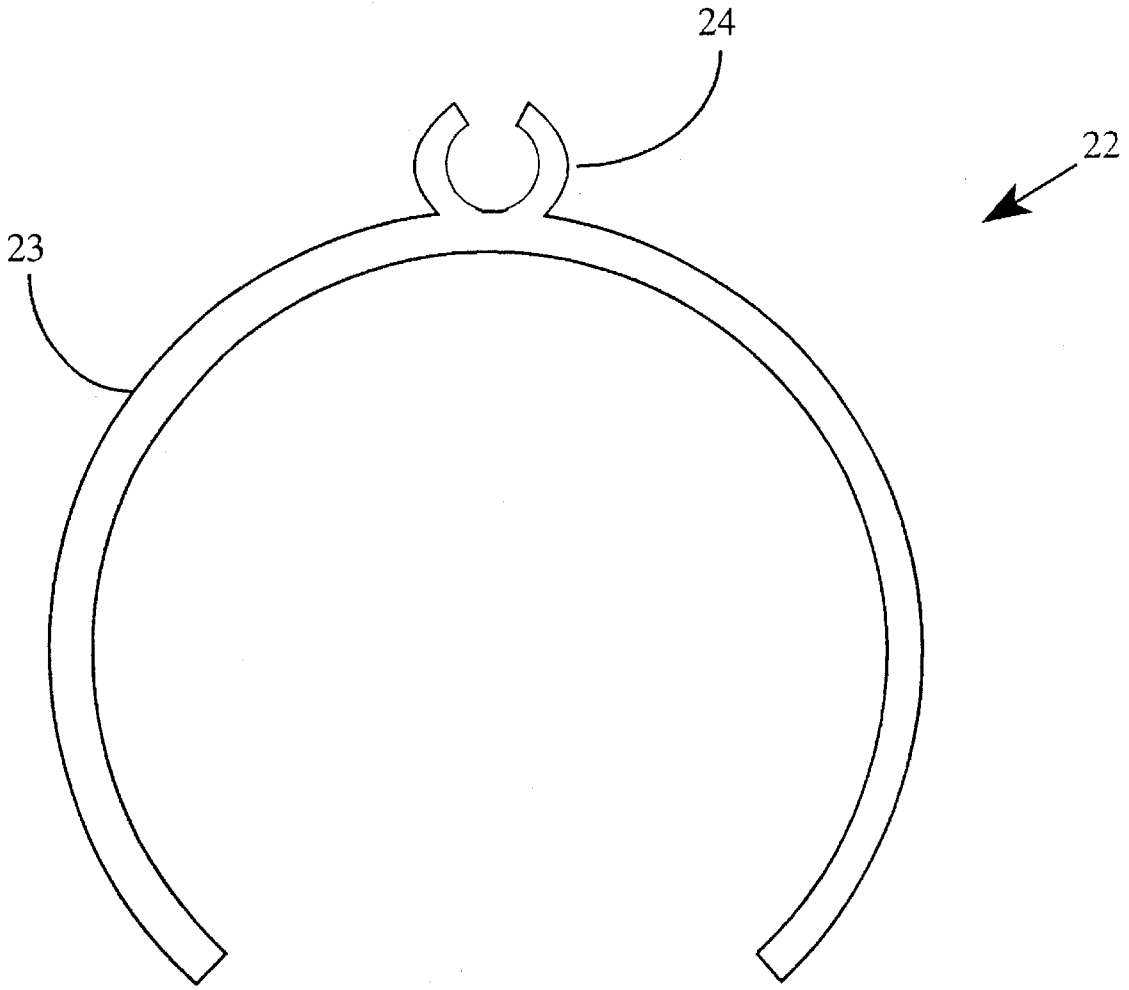
FIG. 3 is a top view of the clip-on device of FIGS. 1 and 2 as removed from the aerosol container; and, FIG. 4 is an enlarged breakaway view of the bracket portion of the clip-on device.

As best shown in FIG. 3, clip-on device 22 has a bracket 24 for engaging a tubular conduit member 26 such as a straw as best seen in FIGS. 1 and 2.

Figure 4:
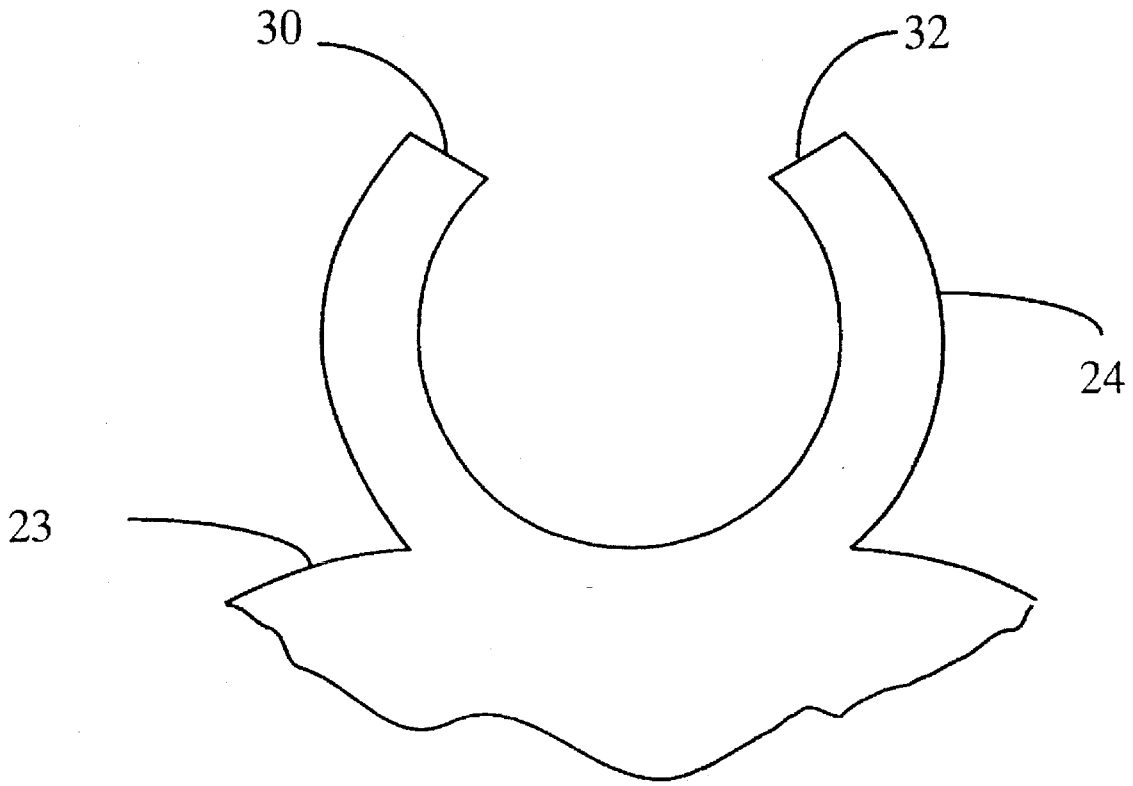

As best seen in FIG. 4, the bracket 24 includes a bracket body portion which is molded integrally with the clip 23. The bracket 24 has jaws 30 and 32 as seen in FIG. 4 which serve to hold straw 26 in position. The bracket 24 has an inner arcuate receiving surface of compatible, dimensional design to the circumferential dimension of the straw 26 to ensure a secure fit when the straw 26 is placed in bracket 24.

The jaws 30 and 32 extend to such an outward position that they form a secure means for the straw 26. It is contemplated that the straw 26 will typically be of a bendable plastic or paper construction whereby it can be wedged into bracket 24 to be held securely in position. While straw 26, when held in this secured holding position, will not fall loose from bracket 24, it can easily be removed by a slight tug when its use is desired to act as a spray guiding means. This use is carried out by holding straw 26 so that one end is pressed against dispenser button 18 so that outlet 20 is surrounded by the straw 26. In this way, spray from outlet 20 can be directed with precision to a pinpointed location such as a small orifice. A broad expanding spray would be wasteful of the spray product assuming that the outlet 20 could not be placed in close proximity to the orifice to receive the spray product.

Figure 5:
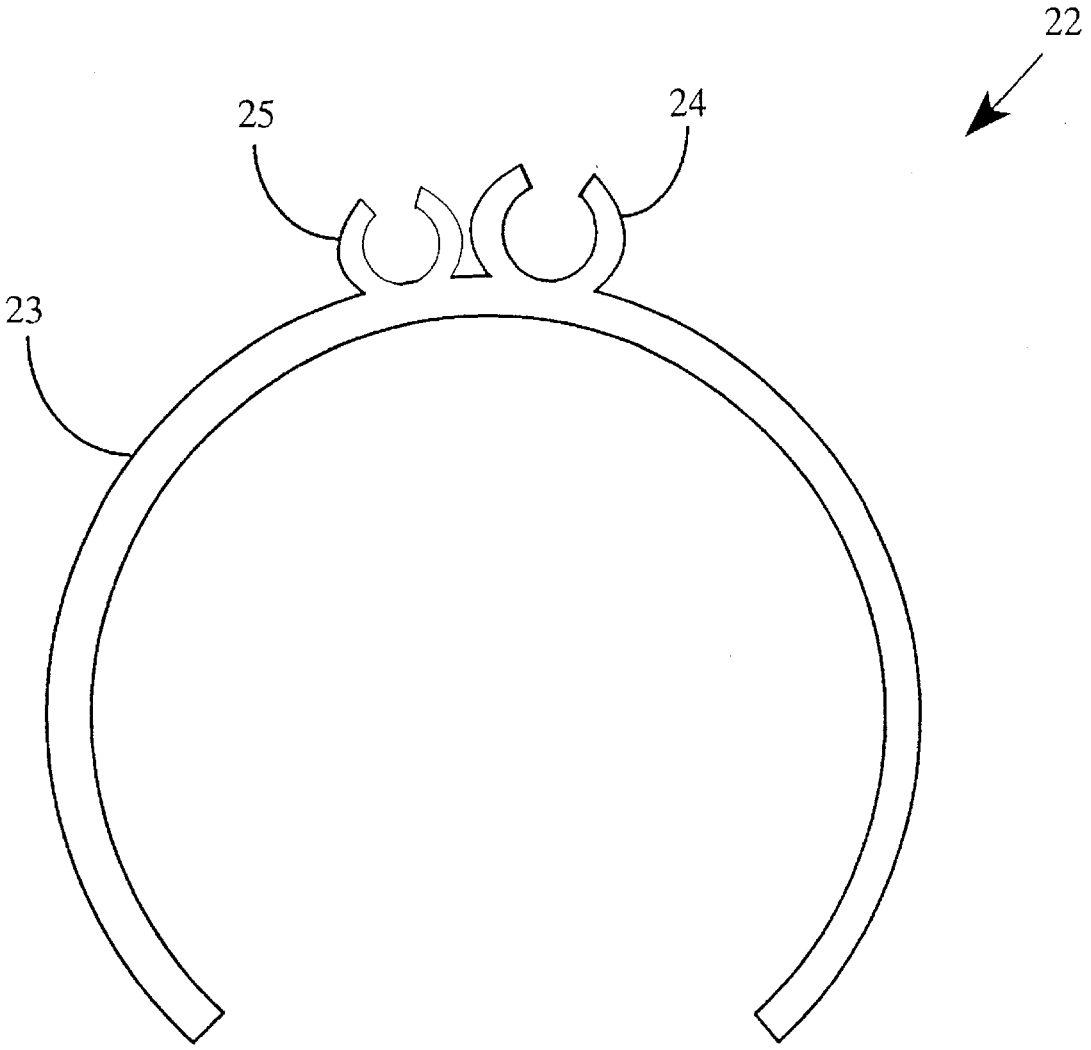
FIG. 5 is a top view of an alternative embodiment of the clip-on device having multiple brackets.

It is contemplated that clip-on device 22 can be attached to an aerosol container 10 before the sale of the container to enable a straw 26 to be sold with the container 10. The clip-on device 22 can provide a single bracket 24 that is dimensioned to securely hold a straw of a predetermined size. Alternatively, as shown in FIG. 5, the clip-on device 22 can include multiple brackets 24, 25 that are each dimensioned to accommodate straws of different sizes so that the clip-on device 22 can be used interchangeably with different containers and different size straws.

Presently, containers are sold with straws attached which are held to the container by tape. While tape will likely secure such straws before sale, once containers are used and the tape is pried loose to release the straw, it is likely that the tape will be less effective in securing the straw in the future. At some point, it becomes likely that the tape will fail altogether to hold the straw at which time the straw may likely be separated from the container and lost. Also, the act of prying loose the tape and then trying to retape the straw in position after use can be viewed as cumbersome and inefficient.

In contrast, in accordance with the subject invention, the straw can be easily pried loose from its bracket 24, used to pinpoint the delivery of spray from the container to a remote location, and then reinserted back into bracket 24 to be held conveniently for future use. As long as straw and container are attached to one another, the likelihood of the straw becoming lost is not great.

The subject invention will find particular use by mechanics and other tradesmen who have the need for using aerosol containers such as those containing lubricants for their daily work. Lubricant sprays may be but one of many items used by such tradesmen and carried in tool boxes or other equipment holders. Efficient use of spray containers becomes much more likely if a straw can be readily available for use with the spray. Efficiency is further enhanced by the straw being ready for use with a minimum of effort. In accordance with the subject invention, it can be pulled from its holding bracket 24 by a slight tug as contrasted to the need to free it by unpeeling tape if the straw is taped to the container. If the straw is not taped to the container but lying loose somewhere, chances are that some time may be lost in finding the straw or pulling it loose from a series of tools or other items where it may have fallen if not secured to the container itself.

Various modifications and alterations will be apparent to those of ordinary skill in the art and such modifications and alterations are intended to be covered by the following claims.

I claim:

1. A device for holding straws to a cylindrical aerosol container when said straws are not being used to direct spray from said container, said device comprising:

a clip-on device having a friction fit, flexible, circular clip-on portion to be attached to a side wall of said aerosol container, said clip-on portion extending substantially but not completely around said sidewall portion as a C-shaped clip, whereby said clip-on portion can snugly engage said side wall; and said clip-on device including two integral brackets, each of said integral brackets removably receiving by friction fit a straw, each of said integral brackets being formed by a pair of curved legs unitarily formed in one piece with the clip-on portion, said pair of curved legs being spaced on said clip portion and having a bridging segment of the clip portion between them, said pair of curved legs extending from the clip-on portion to form with said bridging segment, a complete C-shaped configuration for substantially but not completely surrounding said straw when engaged, whereby said straw can be attached to said container solely by friction fit of said clip-on portion to said side wall and said straw to said bracket, one of said integral brackets having longer curved legs than the other of said brackets for accommodating a larger straw.

* * * * *